US008131172B2

(12) United States Patent
Shiraki et al.

(10) Patent No.: US 8,131,172 B2
(45) Date of Patent: Mar. 6, 2012

(54) IMAGE FORMING APPARATUS

(75) Inventors: Masatoshi Shiraki, Nagoya (JP); Hiroshi Handa, Nagoya (JP); Hiroki Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 114 days.

(21) Appl. No.: 12/719,030

(22) Filed: Mar. 8, 2010

(65) Prior Publication Data

US 2010/0226675 A1 Sep. 9, 2010

(30) Foreign Application Priority Data

Mar. 9, 2009 (JP) ..... 2009-054616

(51) Int. Cl.
*G03G 15/06* (2006.01)

(52) U.S. Cl. ..... 399/55; 399/281; 399/285

(58) Field of Classification Search ..... 399/53, 399/55, 56, 281, 285
See application file for complete search history.

(56) References Cited

U.S. PATENT DOCUMENTS 5,826,138 A * 10/1998 Tsuru et al. ..... 399/55
6,973,275 B2 * 12/2005 Sasai ..... 399/55
7,103,294 B2 * 9/2006 Kawano ..... 399/55

FOREIGN PATENT DOCUMENTS

JP 10-232544 9/1998
JP 2008-249922 10/2008

* cited by examiner

*Primary Examiner* — Hoang Ngo
(74) *Attorney, Agent, or Firm* — Banner & Witcoff, Ltd.

(57) ABSTRACT

An image forming apparatus is provided. The image forming apparatus includes an accommodating member configured to accommodate developer; a supply member configured to supply the developer of the accommodating member; a developer holding member configured to supply the developer from the supply member to an image holding member; and a voltage controller configured to apply a first predetermined voltage to the supply member and apply a second predetermined voltage to the developer holding member so as to supply the developer from the accommodating member to the electrostatic latent image formed on the image holding member through the supply member and the developer holding member. The voltage controller, when starting to apply a voltage to the supply member, applies an excessive voltage to the supply member, the excessive voltage having a polarity same as the first predetermined voltage and being larger in an absolute value than the first predetermined voltage.

13 Claims, 6 Drawing Sheets

IMAGE FORMING APPARATUS

CROSS-REFERENCE TO RELATED APPLICATION

This application claims priority from Japanese Patent Application No. 2009-054616, filed on Mar. 9, 2009, the entire subject matter of which is incorporated herein by reference.

TECHNICAL FIELD

Aspects of the present invention relate to an image forming apparatus.

BACKGROUND

A developing device is provided in an image forming apparatus, such as a laser printer or the like. The developing device supplies toner accommodated in a toner accommodating chamber to a developing roller through a supply roller to be attached on an electrostatic latent image on the surface of a photosensitive drum, thereby forming a toner image. This toner image formed on the photosensitive drum is transferred to a sheet transported and is then fixed to the sheet by a fixing device provided in the image forming apparatus main body. Accordingly, an image forming operation is completed.

However, in the image forming apparatus, toner which is accommodated in the developing device is deteriorated with the operation time of the developing device, so that an image quality is deteriorated.

SUMMARY

Accordingly, it is an aspect of the present invention to provide an image forming apparatus capable of stably forming an image without deterioration of the image quality.

According to an exemplary embodiment of the present invention, there is provided an image forming apparatus comprising: an accommodating member configured to accommodate developer; a supply member configured to supply the developer in the accommodating member; a developer holding member configured to supply the developer supplied from the supply member to an image holding member on which an electrostatic latent image is formed; and a voltage controller configured to apply a first predetermined voltage to the supply member and apply a second predetermined voltage to the developer holding member so as to supply the developer from the accommodating member to the electrostatic latent image formed on the image holding member through the supply member and the developer holding member. The voltage controller, when starting to apply the first predetermined voltage to the supply member, applies an excessive voltage to the supply member, the excessive voltage having a polarity same as the first predetermined voltage and being larger in an absolute value than the first predetermined voltage.

According to another exemplary embodiment of the present invention, an image forming apparatus comprising: a main body housing, in which a process cartridge is detachably mounted, wherein the process cartridge includes an accommodating member configured to accommodate developer; a photosensitive drum; a supply roller configured to supply developer accommodated in the accommodating member; and a developing roller configured to supply developer from the supply roller on an electrostatic latent image formed on the photosensitive drum; and a voltage controller configured to apply a bias voltage to the supply roller and apply a bias voltage to the developing roller. The voltage controller applies a constant bias voltage to the supply roller and applies a constant bias voltage to the developing roller after the supply roller and the developing roller are rotated. The voltage controller applies an excessive bias voltage to the supply roller before applying the constant bias voltage to the supply roller, the excessive bias voltage having a polarity same as the constant bias voltage to the supply roller and being larger in an absolute value than the constant bias voltage applied to the supply roller.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

<General Overview>

Figure 6:
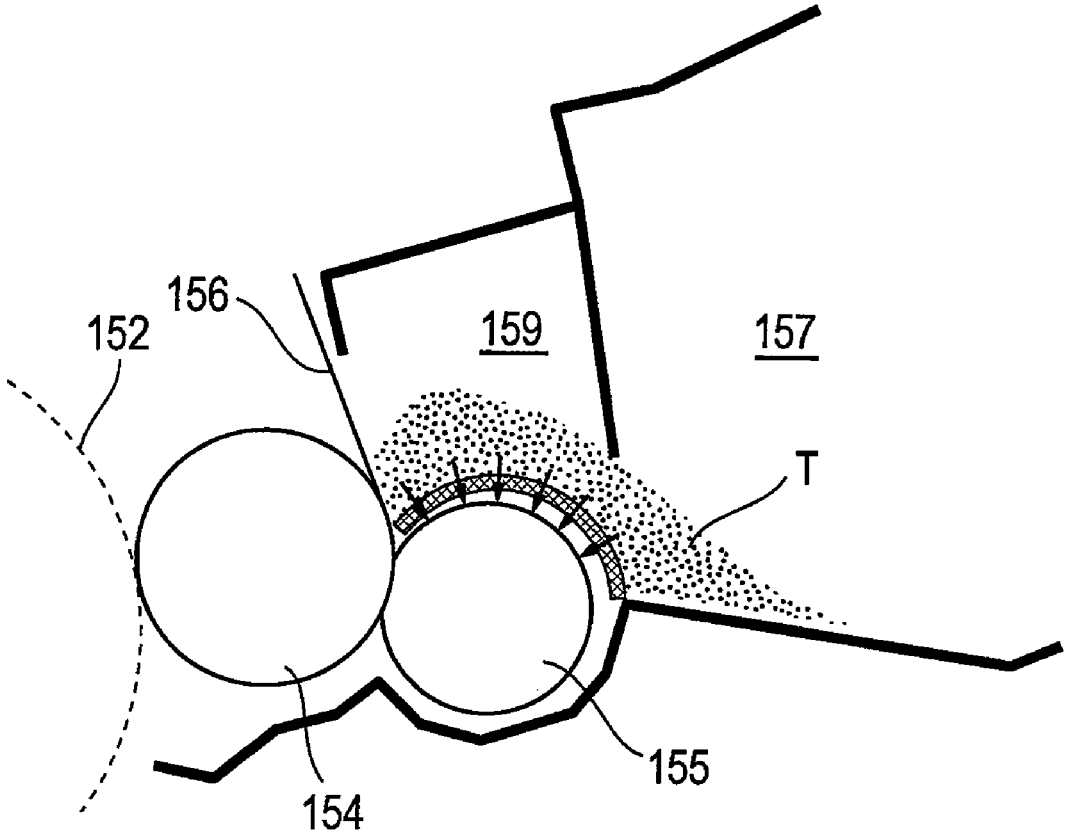
FIG. 6 is a schematic view showing the configuration of a related-art developing device.

In a related-art image forming apparatus, a developing device as shown in FIG. 6 is provided. The developing device supplies toner accommodated in a toner accommodating chamber 157 to a developing roller 154 through a supply roller (supply member) 155 to be attached on an electrostatic latent image formed on the surface of a photosensitive drum 152. Specifically, at first, toner T accommodated in the toner accommodating chamber 157 is sent to the developing chamber 159. A supply roller 155 is rotated such that toner T is attached on the surface thereof.

The supply roller 155 is applied with a predetermined bias voltage and is rotated such that toner T attached on the surface of the supply roller 155 is further supplied to a developing roller 154 at a contact position between the supply roller 155 and the developing roller 154. The developing roller 154 is also applied with a predetermined bias voltage and develops toner T on the electrostatic latent image of the photosensitive drum 152 to form a toner image thereon. A part of toner T which has been not developed on the photosensitive drum 152 returns to the developing chamber 159 through the developing roller 154 and the supply roller 155.

The toner image formed on the photosensitive drum 152 is transferred to a sheet transported and is then fixed to the sheet by a fixing device provided in the image forming apparatus main body. Thus, an image forming operation is completed.

However, in this image forming apparatus, toner which is accommodated in the toner accommodating chamber 157 is deteriorated with the operation time of the developing device. This occurs due to repetitive friction of toner held on the developing roller 154 with the supply roller 155, the photosensitive drum 152, a thickness regulating blade 156, and the like.

In such deteriorated toner, an externally added agent on the surface of toner is separated, so that the fluidity of toner becomes lower than that of new toner. When this deterioration occurs, as shown in FIG. 6, toner is accumulated in the developing chamber 159. In this case, while toner T around the supply roller 155 can be moved by rotation of the supply roller 155, toner at a position slightly away from the supply roller 155 is not supplied and not moved due to its low fluidity so that a toner layer is formed. The unmoved toner layer is then compressed in the arrow direction of FIG. 6 due to the weight of toner T and is accumulated, so that the fluidity of toner is further lowered.

As a result, the amount of toner T supplied to the supply roller 155 decreases, and toner supply to the developing roller 154 becomes short. Accordingly, a print omission error occurs.

Accordingly, it is an aspect of the present invention to provide an image forming apparatus capable of realizing sufficient toner supply to a supply member so as to stably form an image without deterioration of the image quality.

<Exemplary Embodiments>

Exemplary embodiments of the present invention will be described in detail with reference to the accompanying drawings.

Figure 1:
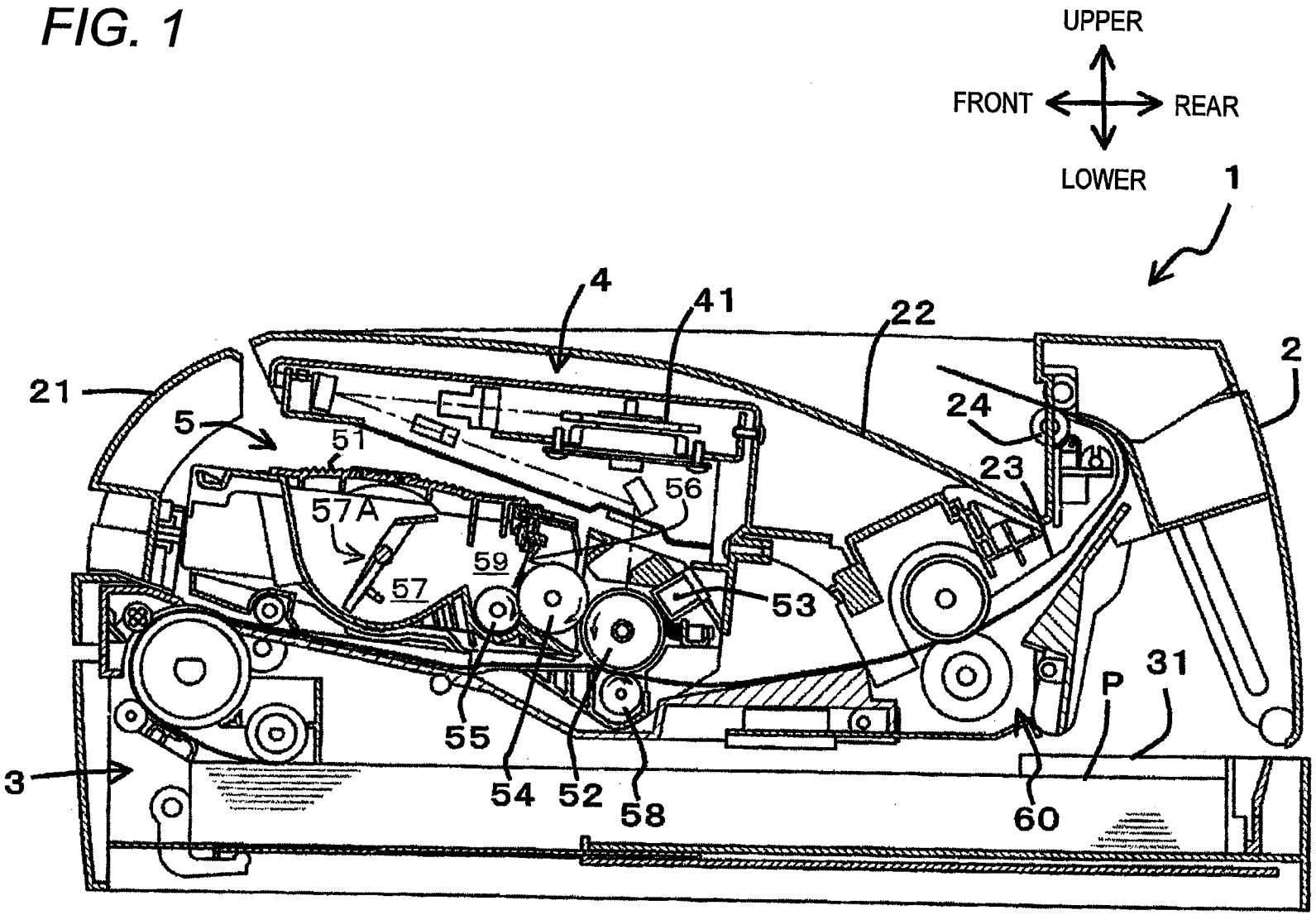
FIG. 1 is a sectional view of a laser printer as an example of an image forming apparatus according to an exemplary embodiment of the present invention.

As shown in FIG. 1, a laser printer 1 includes, in a main body housing 2, a sheet feed unit 3 configured to feed a sheet P, a scanner unit 4, a process cartridge 5 configured to forms a toner image and transfer the toner image to the sheet P, and a fixing unit 60 configured to thermally fix the toner image transferred to the sheet P. On the front side of the main body housing 2, a front cover 21 is openably provided. The process cartridge 5 is detachably mounted through an opening formed when the front cover 21 is open. At the top surface of the main body housing 2, a discharge tray 22 is provided, on which the sheet P discharged from the main body housing 2 is stacked.

The sheet feed unit 3 is provided at the lower part in the main body housing 2. The sheet feed unit 3 has a sheet feed tray 31 which is detachably mounted in the main body housing 2, and various rollers which are provided above the front portion of the sheet feed tray 31 to transport the sheet P from the sheet feed tray 31.

The scanner unit 4 is provided at the upper part of the main body housing 2, and includes a laser light-emitting unit (not shown), a polygon mirror 41 driven to rotate, and various lenses and mirrors. As shown in a chain line, the laser light-emitting unit emits a laser light based on image data. The emitted laser light beam is reflected from or passes through the polygon mirror 41 and various lenses or mirrors and is then irradiated onto the surface of the photosensitive drum 52 of the process cartridge 5 by high-speed scanning.

Figure 2:
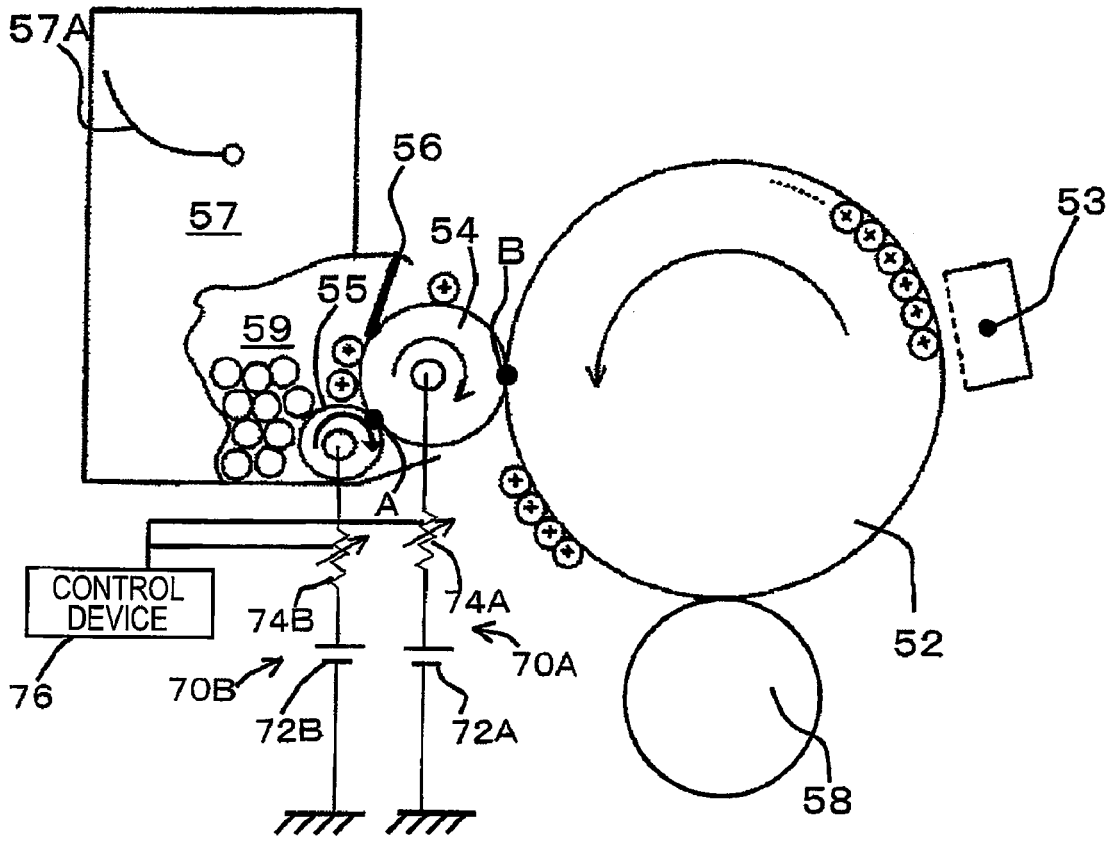
FIG. 2 is a schematic view showing the configuration around a developing roller according to an exemplary embodiment of the present invention.

The process cartridge 5 is detachably mounted in the main body housing 2 below the scanner unit 4. The process cartridge 5 includes a hollow casing 51 which configures an outer frame (as an example of an accommodating member), a photosensitive drum 52 (as an example of an image holding member), a charger 53, a developing roller 54 (as an example of a developer holding member), a supply roller 55 (as an example of a supply member), a thickness regulating blade 56, a toner accommodating part 57, and a transfer roller 58. As shown in FIG. 2, the toner accommodating part 57 accommodates positively chargeable non-magnetic one component toner (as an example of developer).

The developing roller 54 has a surface formed of rubber and is provided to contact the photosensitive drum 52. At the time of image formation described below, the developing roller 54 is rotated such that the peripheral surface thereof moves in the same direction (a clockwise direction of FIG. 2) at a contact position to the photosensitive drum 52. A difference in peripheral speed is provided between the rotation speed of the developing roller 54 and the rotation speed of the photosensitive drum 52. Specifically, the photosensitive drum 52 is rotated at a speed lower than the developing roller 54. The difference in peripheral speed between the photosensitive drum 52 and the developing roller 54 causes toner on the developing roller 54 to move, so that deterioration of the attaching force of toner due to an influence of molecular attraction on toner can be reduced.

The supply roller 55 has a diameter smaller than the developing roller 54, and has a rotation shaft and a conductive foamed sponge roller. The supply roller 55 is constantly in contact with the developing roller 54, and at the time of image formation, the supply roller 55 is rotated such that the peripheral surface moves in an opposite direction (clockwise direction) at the contact position to the developing roller 54.

The developing roller 54 and the supply roller 55 are respectively connected to bias supply units 70A and 70B (as an example of a voltage controller) which are provided in the main body housing 2. The bias supply units 70A and 70B respectively include power supplies 72A and 72B which apply direct voltage, variable resistors 74A and 74B, a control device 76 using a Central Processing Unit (CPU), and the like.

By operating the bias supply units 70A and 70B, a predetermined developing bias voltage (second predetermined voltage) Va and a predetermined supply bias voltage (first predetermined voltage) Vb are respectively applied from the power supplies 72A and 72B to the developing roller 54 and the supply roller 55. If the control device 76 changes the resistance values of the variable resistors 74A and 74B, the values of the bias voltages applied to the developing roller 54 and the supply roller 55 are changed. Control of the bias voltages applied to the developing roller 54 and the supply roller 55 will be described below. The control device 76 performs drive control of the scanner unit 4 and the charger 53.

In the process cartridge 5, the surface of the photosensitive drum 52 is charged uniformly by the charger 53 and then exposed with laser light beam from the scanner unit 4 by high-speed scanning. The potential of the exposed portion becomes lower, so that an electrostatic latent image based on image data is formed.

At this time, as shown in FIG. 2, toner in the toner accommodating part 57 is supplied to the supply roller 55 by rotation of an agitator 57A. Then, toner is moved from the supply roller 55 to the surface of the developing roller 54 at a supply position A where the supply roller 55 and the developing roller 54 contact each other. When toner is supplied from the supply roller 55 to the developing roller 54, toner is positively charged while the supply roller 55 and the developing roller 54 slidably contact each other at the supply position A by rotation of the supply roller 55 and the developing roller 54. Toner supplied on the developing roller 54 is further charged while slidably contacting the thickness regulating blade 56, and is then held on the developing roller 54 as a thin layer having a uniform thickness.

Toner held on the developing roller 54 is attached on an electrostatic latent image formed on the photosensitive drum 52 when the developing roller 54 contacts the photosensitive drum 52 at a developing position B where the developing roller 54 and the photosensitive drum 52 oppose each other. Thus, the electrostatic latent image is visualized into a toner image on the photosensitive drum 52. Then, when the sheet P is transported between the photosensitive drum 52 and the transfer roller 58, the toner image on the photosensitive drum 52 is transferred to the sheet P. Part of toner on the developing roller 54 which has not been attached on the photosensitive drum 52 at the developing position B is returned to the supply roller 55 at the supply position A and is returned to a developing chamber 59.

The sheet P is transported to the fixing unit 60 provided at the rear of the process cartridge 5 (the downstream side in the transport direction of the sheet P), and the toner image transferred to the sheet P is thermally fixed. The sheet P on which the toner image is thermally fixed is transported from a nip portion to a discharge path 23, then discharged from the discharge path 23 outside the main body housing 2 by the discharge roller 24, and subsequently stacked on the discharge tray 22.

[Control of Application of Voltage to Supply Roller]

A control of a bias voltage applied in the above-described laser printer 1 will be described with reference to FIGS. 2 and 3. Here, it is assumed that about 1000 sheets are printed after the new process cartridge 5 is mounted in the main body housing 2, and description will be provided for a case where toner is deteriorated by friction between the developing roller 54, the supply roller 55, the thickness regulating blade 56, and the photosensitive drum 52, and toner having insufficient fluidity is accumulated on the supply roller 55.

When the image forming operation starts, as shown in FIG. 2, the photosensitive drum 52, the developing roller 54, and the supply roller 55 start to rotate in the arrow directions, respectively. Then, as shown in FIG. 3, the charger 53 starts charging so that the surface of the photosensitive drum 52 is charged and has a potential of 800 V. Thereafter, the scanner unit 4 starts exposure. The potential of a portion of the surface of the photosensitive drum 52, which is exposed to a laser light beam from the scanner unit 4, becomes lower to 200 V, and the portion where the potential becomes lower forms an electrostatic latent image.

While the electrostatic latent image is formed on the photosensitive drum 52, the supply roller 55 and the developing roller 54 rotate to supply toner from the supply roller 55 onto the surface of the developing roller 54 at the supply position A (see FIG. 2). When a predetermined time has elapsed after the charging and the exposure start, the supply bias voltage Vs is applied to the supply roller 55 at a time t1, and the developing bias voltage Vd is applied to the developing roller 54 at a time t2.

Specifically, at the time of the start applying a bias voltage, an excessive voltage of 630 V is applied instantaneously to the supply roller 55 as the supply bias voltage Vs, and then a predetermined voltage of 600 V is applied to the supply roller 55 as the supply bias voltage Vs. The predetermined voltage applied to the supply roller 55 may be constant after the application of the excessive voltage. Thereafter, a predetermined voltage of 400 V is applied to the developing roller 54 as the developing bias voltage Vd. The developing bias voltage Vd is set to be lower than the supply bias voltage Vs so that positively charged toner attached on the developing roller 54 is not pulled toward the supply roller 55. The predetermined voltage applied to the developing roller 54 may be constant after starting of the application thereof. The excessive voltage has the same polarity of the predetermined voltage applied after the excessive voltage application and is larger in an absolute value than the predetermined voltage. It is noted that the excessive voltage is preferably larger than the predetermined voltage by 1% to 10%. The application time period of the excessive voltage is preferably in a range of 20 milliseconds to 1 second.

The time t1 at which the supply bias voltage Vs is applied to the supply roller 55 is preferably earlier than the time t2 at which the developing bias voltage Vd is applied to the developing roller 54. If the time at which a voltage is applied to the developing roller 54 is earlier than the time at which a voltage is applied to the supply roller 55, there occurs a period in which the potential of the developing roller 54 is higher than that of the supply roller 55. When this occurs, positively charged toner on the developing roller 54 is pulled toward the supply roller 55 due to a potential difference between the developing roller 54 and the supply roller 55. Therefore, the supply bias voltage Vs is applied to the supply roller 55 at least until a bias voltage is applied to the developing roller 54 such that the surface potential of the supply roller 55 is always higher than that of the developing roller 54.

The application of the excessive voltage preferably ends so that that toner supplied to the developing roller 54 after the application of the excessive voltage ends is attached to the leading end of the electrostatic latent image formed on the photosensitive drum 52, from which the electrostatic latent image is developed. Therefore, to ensure a time period in which toner on the developing roller 54 reaches the developing position, a time period from a time at which the application of the excessive voltage ends to a time t3 (see FIG. 3) at which the leading end of the electrostatic latent image starts to be developed at the developing position B needs to be longer than the time period required for toner on the developing roller 54 to move from the supply position A to the developing position B. Herein, the end of application of the excessive voltage is the time at which the supply bias voltage Vs becomes the predetermined supply bias voltage 600 V (see FIG. 3).

According to the above-described configuration, when the excessive voltage is applied to the supply roller 55, an electric field stronger than that when a predetermined voltage is applied is generated around the supply roller 55. Toner accumulated around the supply roller 55 is subjected to a force in a direction away from the supply roller 55 due to a reactive force caused by the electric field, so that the accumulated toner layer can be destroyed or collapsed. When the toner layer is destroyed, fluidity of toner around the supply roller 55 is recovered. As a result, a sufficient amount of toner for printing can be supplied to the supply roller 55 after application of the excessive voltage. Accordingly, quality deterioration in printing does not occur.

Figure 3:
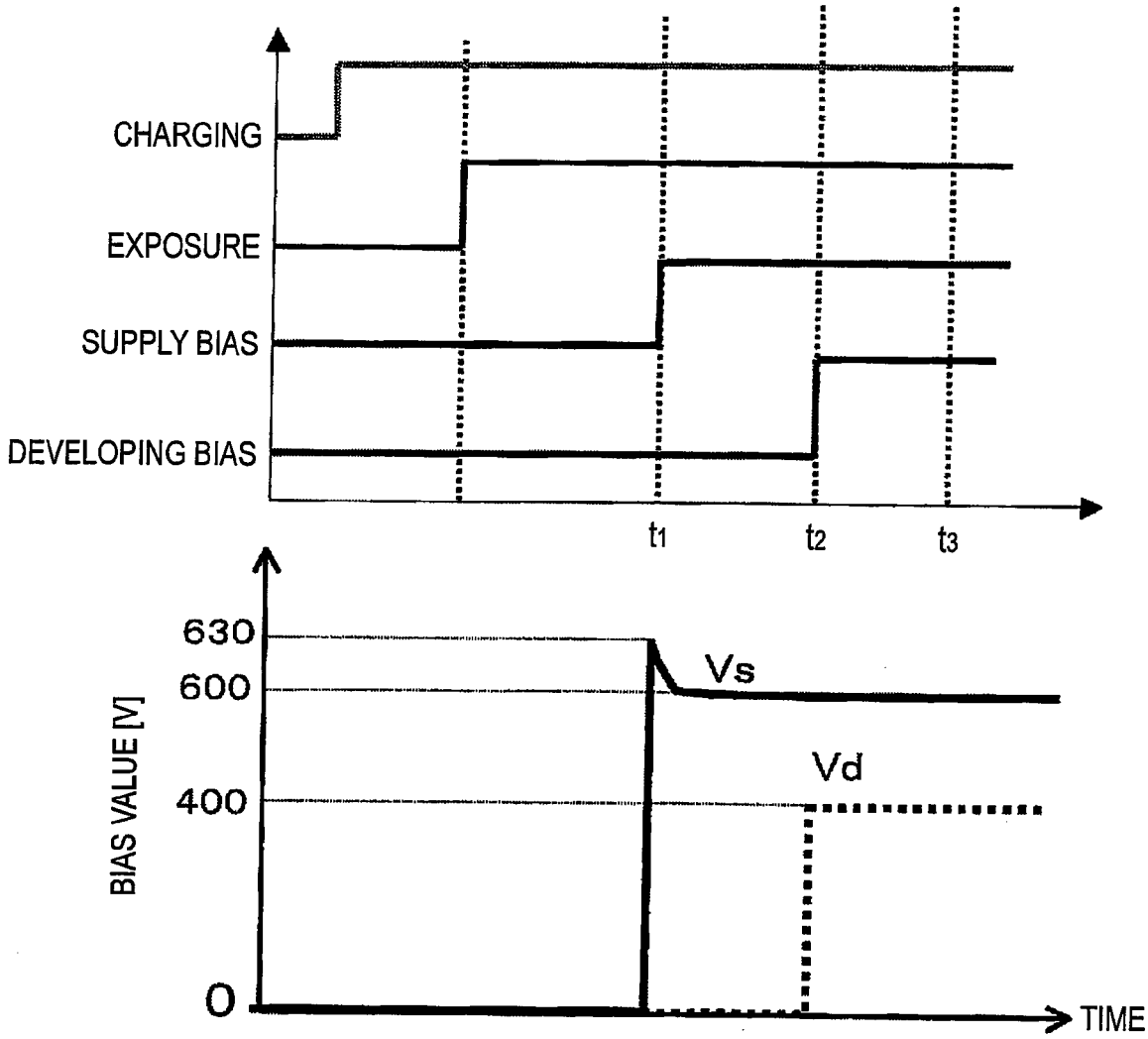
FIG. 3 is a timing chart showing a drive timing of respective units of the laser printer according to an exemplary embodiment of the present invention and a graph showing the values of bias voltages corresponding to the timing chart.

Further, after application of the excessive voltage, the supply roller 55 supplies a sufficient amount of toner to the surface of the developing roller 54 at the supply position A, and toner on the developing roller 54 is conveyed to the developing position B and supplied to the electrostatic latent image on the photosensitive drum 52 (time t3 of FIG. 3). In this course, toner supplied to the developing roller 54 after application of the excessive voltage reaches the developing position B earlier than the leading end of the electrostatic latent image reaches the developing position B, and therefore, the amount of toner attached to the electrostatic latent image does not become insufficient. Accordingly, quality deterioration in printing does not occur.

The excessive voltage is applied after the supply roller 55 and the developing roller 54 start to rotate. If the excessive voltage is applied while the supply roller 55 and the developing roller 54 are stationary (are not rotated), the excessive voltage concentrates on a space between the two rollers, that is, on toner around the supplied position A, and only toner at that portion may be deteriorated. Meanwhile, if the excessive voltage is applied while the supply roller 55 and the developing roller 54 are rotated, toner continues to be turned over at the supply position A. Therefore, the excessive voltage is dispersively applied to toner, not being intensively applied only to a part of toner, so that toner can be prevented from being partially deteriorated.

In particular, in the above-described exemplary embodiment, non-magnetic one component toner is used, and the photosensitive drum 52 and the developing roller 54 come into contact with each other. Therefore, the toner is significantly deteriorated by friction between the developing roller 54 and the photosensitive drum 52. However, fluidity of toner can be favorably recovered by the effect of application of the excessive voltage.

[Other Exemplary Embodiments]

Figure 4:
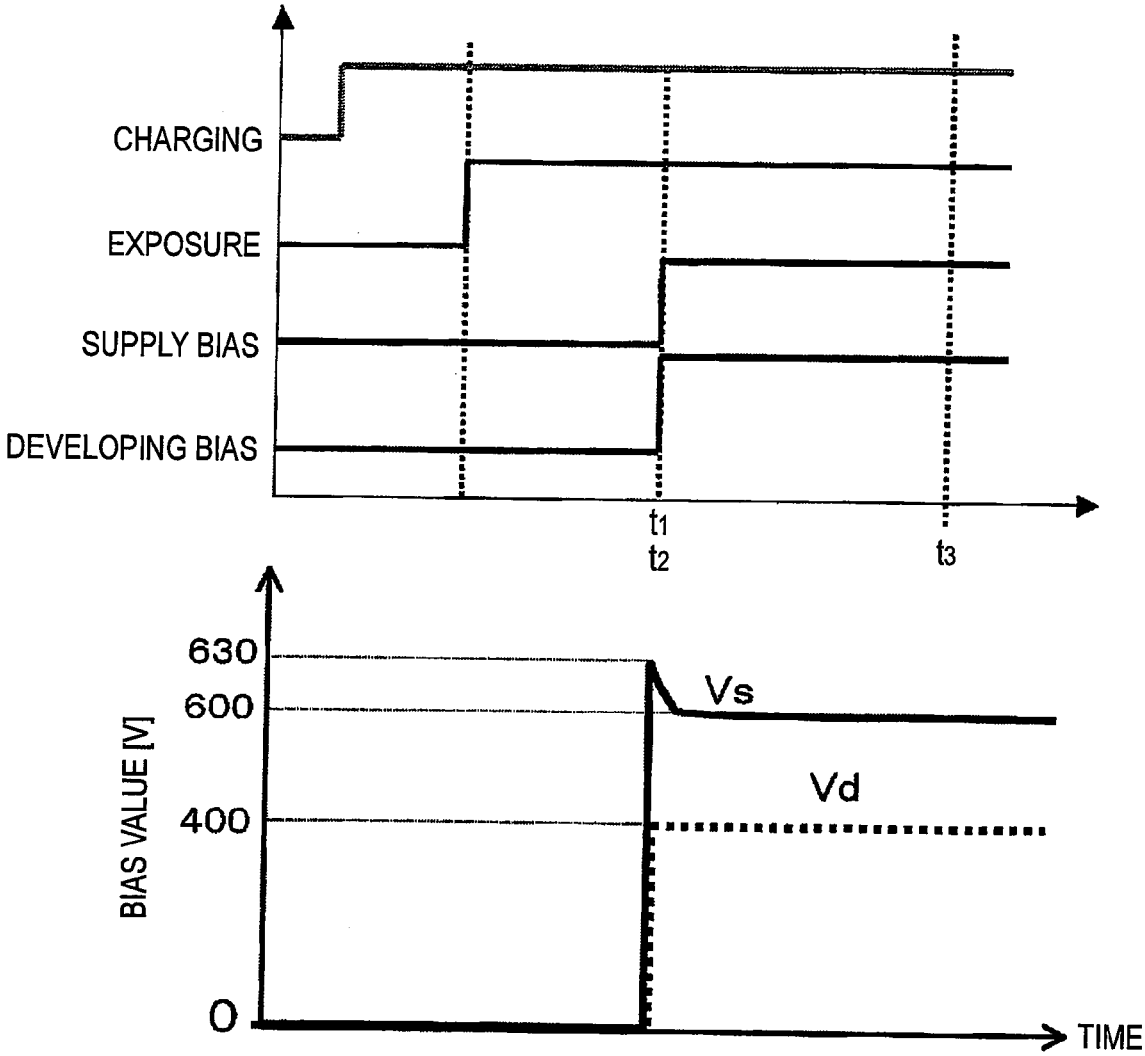
FIG. 4 is a timing chart showing a drive timing of the respective units of the laser printer according to another exemplary embodiment of the present invention and a graph showing the values of bias voltages corresponding to the timing chart.

Other exemplary embodiments of the present invention will be described with reference to FIGS. 4 and 5. The portions common to the above-described exemplary embodiment are represented by the same reference numerals, and description thereof will not be repeated.

In the above-described exemplary embodiment, the supply bias voltage Vs starts to be applied earlier than the developing bias voltage Vd. However, as shown in FIG. 4, the supply bias voltage Vs and the developing bias voltage Vd may start to be applied at the same time. Even though the supply bias voltage Vs and the developing bias voltage Vd start to be applied at the same time, toner does not return from the developing roller 54 to the supply roller 55.

If the supply bias voltage Vs and the developing bias voltage Vd start to be applied at the same time, deterioration of toner can be lessened. If the supply bias voltage Vs starts to be applied earlier than the developing bias voltage Vd, a potential difference between the developing roller 54 and the supply roller 55 becomes larger immediately after application of the supply bias voltage Vs. If this occurs, toner is more likely to be pulled toward the developing roller 54 when supplied from the supply roller 55 to the developing roller 54. However, a superfluous force acts on toner during being supplied to the developing roller 54. Therefore, toner is deteriorated more quickly. However, when the developing bias voltage Vd and the supply bias voltage Vs start to be applied at the same time, the potential difference between the developing roller 54 and the supply roller 55 is smaller, so that deterioration of toner can be lessened.

Figure 5:
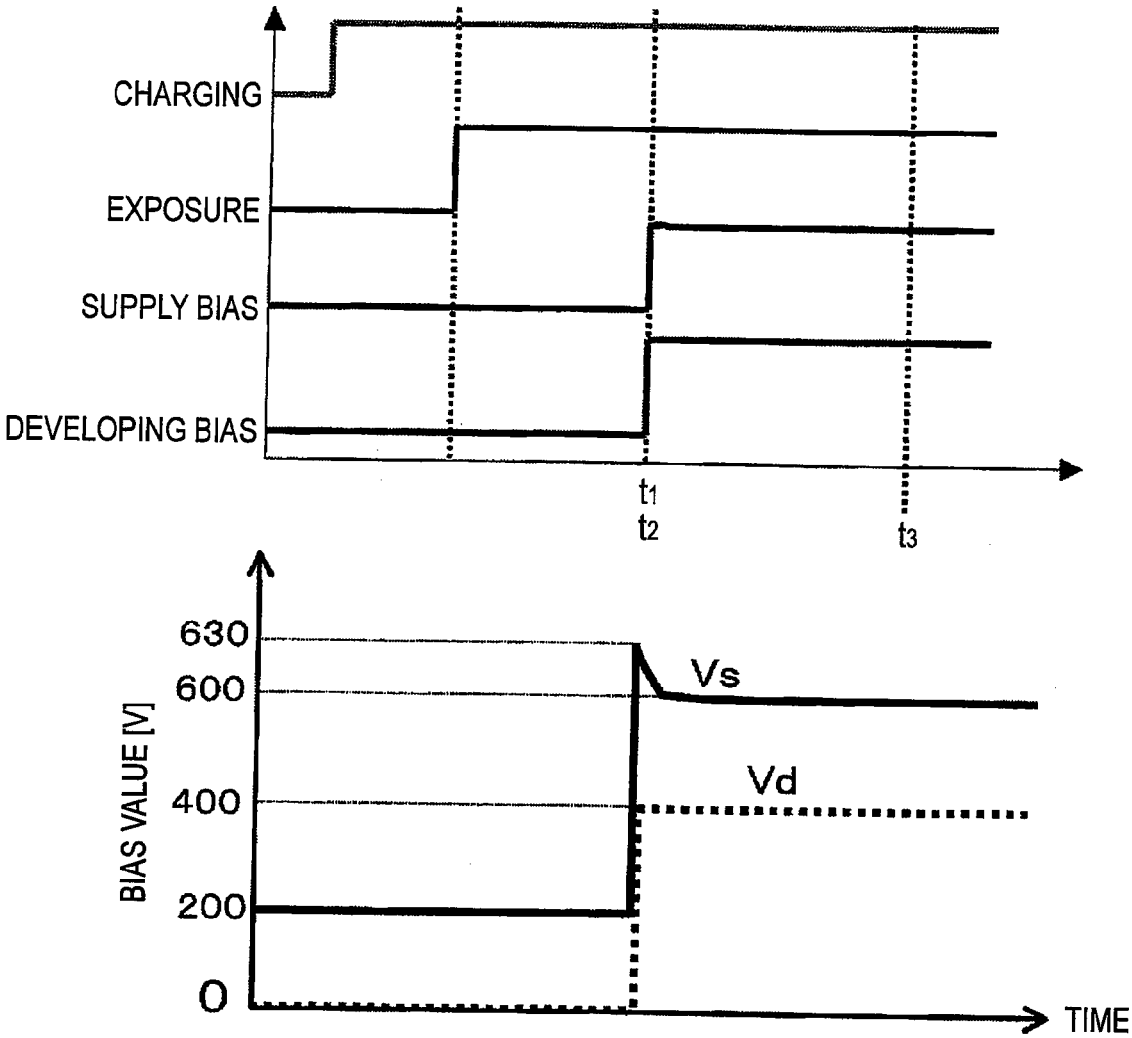
FIG. 5 is a timing chart showing a drive timing of the respective units of the laser printer according to a further exemplary embodiment of the present invention and a graph showing the values of bias voltages corresponding to the timing chart.

Further, as shown in FIG. 5, a voltage of 200 V may be applied in advance as the supply bias voltage Vs so that the potential difference between the developing bias voltage Vd and the supply bias voltage Vs becomes uniform (in the exemplary embodiment, 200 V) before and after the application of the excessive voltage. By controlling the supply bias voltage Vs and the developing bias voltage Vd in this manner, a time at which a larger potential difference between the supply roller 55 and the developing roller 54 is generated due to application of the excessive voltage can be reduced. Accordingly, deterioration of toner and deterioration in conduction to a control circuit in the image forming apparatus can be suppressed. The developing bias voltage Vd may be controlled such that the potential difference becomes uniform even at the time of application of the excessive voltage.

Further, the present invention may be applied to a laser printer which uses negatively chargeable toner, instead of the above-described positively chargeable toner. The same power supply may be used to apply voltage to the supply roller 55 and the developing roller 54.

What is claimed is:

1. An image forming apparatus comprising:

an accommodating member configured to accommodate developer;

a supply member configured to supply the developer in the accommodating member;

a developer holding member configured to supply the developer supplied from the supply member to an image holding member on which an electrostatic latent image is formed; and a voltage controller configured to apply a first predetermined voltage to the supply member and apply a second predetermined voltage to the developer holding member so as to supply the developer from the accommodating member to the electrostatic latent image formed on the image holding member through the supply member and the developer holding member, wherein the voltage controller, when starting to apply the first predetermined voltage to the supply member, applies an excessive voltage to the supply member, the excessive voltage having a polarity same as the first predetermined voltage and being larger in an absolute value than the first predetermined voltage.

2. The image forming apparatus according to claim 1, wherein the excessive voltage applied to the supply member by the voltage controller has a polarity same as the second predetermined voltage applied to the developer holding member and is larger in absolute value than the second predetermined voltage.

3. The image forming apparatus according to claim 1, wherein the voltage controller includes a time controller configured to control a time period of an application of the excessive voltage, and wherein the time controller controls the application of the excessive voltage to end so that developer supplied to the developer holding member after the application of the excessive voltage ends is supplied to a leading end of the electrostatic latent image.

4. The image forming apparatus according to claim 3, wherein the developer holding member includes a developing roller configured to rotate to supply the developer to be attached on the electrostatic latent image formed on the image holding member, wherein the supply member includes a supply roller configured to rotate and slidably contact the developing roller to supply the developer to the developing roller, and wherein the time controller controls the application of the excessive voltage to start after the developing roller and the supply roller start to rotate.

5. The image forming apparatus according to claim 1, wherein a difference between a voltage applied to the developer holding member and a voltage applied to the supply member is same between before and after the excessive voltage is applied.

6. The image forming apparatus according to claim 1, wherein the developer includes non-magnetic one component toner, and toner on the developer holding member is attached onto the image holding member at a position where the developer holding member comes into contact with the image holding member.

7. The image forming apparatus according to claim 1, wherein the excessive voltage is larger than the first predetermined voltage by 1% to 10%.

8. The image forming apparatus according to claim 1, wherein the excessive voltage is applied in a range of 20 milliseconds to 1 second.

9. The image forming apparatus according to claim 1, wherein the voltage controller starts to apply the second predetermined voltage to the developer holding member at the same time as applying the excessive voltage to the supply member.

10. An image forming apparatus comprising:

a main body housing, in which a process cartridge is detachably mounted, wherein the process cartridge includes an accommodating member configured to accommodate developer; a photosensitive drum; a supply roller configured to supply developer accommodated in the accommodating member; and a developing roller configured to supply developer from the supply roller on an electrostatic latent image formed on the photosensitive drum; and a voltage controller configured to apply a bias voltage to the supply roller and apply a bias voltage to the developing roller, wherein the voltage controller applies a constant bias voltage to the supply roller and applies a constant bias voltage to the developing roller after the supply roller and the developing roller are rotated, and wherein the voltage controller applies an excessive bias voltage to the supply roller before applying the constant bias voltage to the supply roller, the excessive bias voltage having a polarity same as the constant bias voltage applied to the supply roller and being larger in an absolute value than the constant bias voltage applied to the supply roller.

11. The image forming apparatus according to claim 10, wherein the voltage controller includes a power supply and a variable resistor connected to the supply roller, and wherein the excessive bias voltage and the constant bias voltage are applied by changing a resistance value of the variable resistor.

12. The image forming apparatus according to claim 10, wherein the excessive bias voltage is larger than the constant bias voltage applied to the supply roller by 1% to 10%.

13. The image forming apparatus according to claim 10, wherein the excessive bias voltage is applied in a range of 20 milliseconds to 1 second.

* * * * *